US009002047B2

(12) United States Patent
Lin et al.

(10) Patent No.: US 9,002,047 B2
(45) Date of Patent: Apr. 7, 2015

(54) METHOD AND APPARATUS FOR AN INSULATED ELECTROMAGNETIC SHIELD FOR USE IN HEARING ASSISTANCE DEVICES

(75) Inventors: Wei Li Lin, Plymouth, MN (US); James R. Newton, Burnsville, MN (US); Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1097 days.

(21) Appl. No.: 12/842,305

(22) Filed: Jul. 23, 2010

(65) Prior Publication Data

US 2011/0044485 A1 Feb. 24, 2011

Related U.S. Application Data

(60) Provisional application No. 61/228,091, filed on Jul. 23, 2009.

(51) Int. Cl.
*H04R 25/00* (2006.01)

(52) U.S. Cl.
CPC ..... *H04R 25/604* (2013.01); *H04R 25/554* (2013.01); *H04R 2225/49* (2013.01)

(58) Field of Classification Search
CPC ..... H04R 25/65; H04R 25/658
USPC ..... 381/318, 322
See application file for complete search history.

(56) References Cited

U.S. PATENT DOCUMENTS

| | | | |
|---|---|---|---|
| 2,327,320 | A | 8/1943 | Shapiro |
| 3,728,509 | A | 4/1973 | Shimojo |
| 3,812,300 | A | 5/1974 | Brander et al. |
| 4,017,834 | A | 4/1977 | Cuttill et al. |
| 4,310,213 | A | 1/1982 | Fetterolf, Sr. et al. |
| 4,729,166 | A | 3/1988 | Lee et al. |
| 5,606,621 | A | 2/1997 | Reiter et al. |
| 5,640,457 | A | 6/1997 | Gnecco et al. |
| 5,687,242 | A | 11/1997 | Iburg |
| 5,708,720 | A | 1/1998 | Meyer |
| 5,740,261 | A | 4/1998 | Loeppert et al. |
| 5,755,743 | A | 5/1998 | Volz et al. |

(Continued)

FOREIGN PATENT DOCUMENTS

| | | |
|---|---|---|
| DE | 1247402 | 8/1967 |
| DE | 3006235 A1 | 10/1980 |

(Continued)

OTHER PUBLICATIONS

"U.S. Appl. No. 10/894,576, Non-Final Office Action mailed Jul. 2, 2007", 12 pgs.

(Continued)

*Primary Examiner* — Ramon Barrera
(74) *Attorney, Agent, or Firm* — Schwegman Lundberg & Woessner, P.A.

(57) ABSTRACT

The present subject matter of the invention relates generally to the management of electromagnetic fields in hearing assistance devices, such as hearing aids, and in particular to an insulated electromagnetic shield design for hearing assistance devices. The present disclosure includes various embodiments for electromagnetic shielding of a receiver using a magnetic shield that is electrically insulated from the receiver casing and electronics.

22 Claims, 3 Drawing Sheets

(56) References Cited

U.S. PATENT DOCUMENTS

| | | | | |
|---|---|---|---|---|
| 5,824,968 | A | 10/1998 | Packard et al. | |
| 5,987,146 | A | 11/1999 | Pluvinage et al. | |
| 6,031,923 | A | 2/2000 | Gnecco et al. | |
| 6,563,045 | B2 | 5/2003 | Goett et al. | |
| 6,766,030 | B1 | 7/2004 | Chojar | |
| 6,876,074 | B2 | 4/2005 | Kim | |
| 7,003,127 | B1 | 2/2006 | Sjursen et al. | |
| 7,016,512 | B1 | 3/2006 | Freeley et al. | |
| 7,065,224 | B2 | 6/2006 | Cornelius et al. | |
| 7,110,562 | B1 | 9/2006 | Feeley et al. | |
| 7,139,404 | B2 | 11/2006 | Feeley et al. | |
| 7,142,682 | B2 | 11/2006 | Mullenborn et al. | |
| 7,181,035 | B2 | 2/2007 | Van Halteren et al. | |
| 7,256,747 | B2 | 8/2007 | Victorian et al. | |
| 7,320,832 | B2 | 1/2008 | Palumbo et al. | |
| 7,354,354 | B2 | 4/2008 | Palumbo et al. | |
| 7,446,720 | B2 | 11/2008 | Victorian et al. | |
| 7,460,681 | B2 | 12/2008 | Geschiere et al. | |
| 7,471,182 | B2 | 12/2008 | Kumano et al. | |
| 7,593,538 | B2 | 9/2009 | Polinske | |
| 8,103,039 | B2 * | 1/2012 | van Halteren et al. | 381/355 |
| 8,259,975 | B2 * | 9/2012 | Bally et al. | 381/322 |
| 8,798,299 | B1 | 8/2014 | Higgins et al. | |
| 2002/0061113 | A1 | 5/2002 | van Halteren et al. | |
| 2003/0178247 | A1 | 9/2003 | Saltykov | |
| 2003/0200820 | A1 | 10/2003 | Takad et al. | |
| 2004/0028251 | A1 | 2/2004 | Kasztelan et al. | |
| 2004/0114776 | A1 | 6/2004 | Crawford et al. | |
| 2004/0240693 | A1 | 12/2004 | Rosenthal | |
| 2005/0008178 | A1 | 1/2005 | Joergensen et al. | |
| 2006/0008110 | A1 * | 1/2006 | van Halteren | 381/417 |
| 2006/0018495 | A1 | 1/2006 | Geschiere et al. | |
| 2006/0097376 | A1 | 5/2006 | Leurs et al. | |
| 2007/0036374 | A1 | 2/2007 | Bauman et al. | |
| 2007/0188289 | A1 | 8/2007 | Kumano et al. | |
| 2008/0003736 | A1 | 1/2008 | Arai et al. | |
| 2008/0026220 | A9 | 1/2008 | Bi et al. | |
| 2008/0187157 | A1 | 8/2008 | Higgins | |
| 2008/0199971 | A1 | 8/2008 | Tondra | |
| 2009/0074218 | A1 | 3/2009 | Higgins | |
| 2009/0075083 | A1 | 3/2009 | Bi et al. | |
| 2009/0196444 | A1 | 8/2009 | Solum | |
| 2009/0245558 | A1 | 10/2009 | Spaulding | |
| 2009/0262964 | A1 | 10/2009 | Havenith et al. | |
| 2010/0034410 | A1 | 2/2010 | Link et al. | |
| 2010/0074461 | A1 | 3/2010 | Polinske | |
| 2010/0124346 | A1 | 5/2010 | Higgins | |
| 2010/0135513 | A1 | 6/2010 | Geschiere et al. | |
| 2010/0158291 | A1 | 6/2010 | Polinske et al. | |
| 2010/0158293 | A1 | 6/2010 | Polinske et al. | |
| 2010/0158295 | A1 | 6/2010 | Polinske et al. | |
| 2012/0014549 | A1 | 1/2012 | Higgins et al. | |

FOREIGN PATENT DOCUMENTS

| | | | |
|---|---|---|---|
| DE | 3502178 | A1 | 8/1985 |
| DE | 3643124 | A1 | 7/1988 |
| DE | 4005476 | A1 | 7/1991 |
| DE | 9320391 | U1 | 9/1993 |
| DE | 9408054 | U1 | 5/1994 |
| DE | 29801567 | U1 | 5/1998 |
| DE | 102008045668 | A1 | 9/2008 |
| EP | 0339877 | A3 | 11/1989 |
| EP | 0424916 | B1 | 7/1995 |
| EP | 0866637 | A2 | 9/1998 |
| EP | 1065863 | A2 | 1/2001 |
| EP | 1209948 | A2 | 5/2002 |
| EP | 1465457 | A2 | 10/2004 |
| EP | 1496530 | A2 | 1/2005 |
| EP | 1209948 | A3 | 7/2006 |
| EP | 1811808 | A1 | 7/2007 |
| EP | 1816893 | A1 | 8/2007 |
| EP | 1850630 | A2 | 10/2007 |
| EP | 1916561 | A2 | 4/2008 |
| EP | 1916561 | A3 | 4/2008 |
| EP | 1920634 | B1 | 2/2009 |
| EP | 2040343 | A1 | 3/2009 |
| GB | 1298089 | | 11/1972 |
| GB | 1522549 | | 8/1978 |
| JP | 2209967 | A | 8/1990 |
| JP | 2288116 | A | 11/1990 |
| JP | 09199662 | A | 7/1997 |
| WO | WO-0079832 | A2 | 12/2000 |
| WO | WO-2004025990 | A1 | 3/2004 |
| WO | WO-2006094502 | A1 | 9/2006 |
| WO | WO-2007027152 | A1 | 3/2007 |
| WO | WO-2007112404 | A2 | 10/2007 |
| WO | WO-2007112404 | A3 | 10/2007 |
| WO | WO-2007140403 | A2 | 12/2007 |
| WO | WO-2007140403 | A3 | 12/2007 |
| WO | WO-2007148154 | A1 | 12/2007 |
| WO | WO-2008092265 | A1 | 8/2008 |
| WO | WO-2008097600 | A1 | 8/2008 |
| WO | WO-2008097600 | C1 | 8/2008 |

OTHER PUBLICATIONS

"U.S. Appl. No. 10/894,576, Non-Final Office Action mailed Dec. 18, 2007", 11 pgs.
"U.S. Appl. No. 10/894,576, Notice of Allowance mailed Aug. 5, 2008", 7 pgs.
"U.S. Appl. No. 10/894,576, Response filed Apr. 18, 2008 to Non-Final Office Action mailed Dec. 18, 2007", 10 pgs.
"U.S. Appl. No. 10/894,576, Response filed Oct. 1, 2007 to Non-Final Office Action mailed Jul. 2, 2007", 10 pgs.
"U.S. Appl. No. 11/857,439 , Response filed Dec. 17, 2011 to Non Final Office Action mailed Aug. 17, 2011", 12 pgs.
"U.S. Appl. No. 11/857,439, Final Office Action mailed Feb. 29, 2012", 16 pgs.
"U.S. Appl. No. 11/857,439, Non Final Office Action mailed Aug. 17, 2011", 16 pgs.
"U.S. Appl. No. 11/857,439, Response filed Jun. 13, 2011 to Restriction Requirement mailed May 11, 2011", 8 pgs.
"U.S. Appl. No. 11/857,439, Restriction Requirement Action mailed May 11, 2011", 6 pgs.
"U.S. Appl. No. 12/027,173, Final Office Action mailed Dec. 8, 2011", 12 pgs.
"U.S. Appl. No. 12/027,173, Non Final Office Action mailed Jul. 11, 2011", 10 pgs.
"U.S. Appl. No. 12/027,173, Response filed Nov. 14, 2011 to Non Final Office Action mailed Jul. 11, 2011", 8 pgs.
"U.S. Appl. No. 12/325,838, Non Final Office Action mailed Jun. 16, 2011", 5 pgs.
"U.S. Appl. No. 12/548,051, Non Final Office Action mailed Oct. 12, 2011", 11 pgs.
"U.S. Appl. No. 12/548,051, Response filed Jan. 12, 2012 to Non Final Office Action mailed Oct. 12, 2011", 9 pgs.
"European Application Serial No. 08253065.0, European Examination Notification mailed Oct. 11, 2011", 7 pgs.
"European Application Serial No. 08253065.0, European Office Action mailed Aug. 26, 2010", 6 Pgs.
"European Application Serial No. 08253065.0, Extended Search Report Mailed Dec. 15, 2008", 9 pgs.
"European Application Serial No. 08253065.0, Office Action mailed Jul. 17, 2009", 1 pg.
"European Application Serial No. 08253065.0, Response filed Jan. 26, 2010 to Office Action mailed Jul. 17, 2009", 9 pgs.
"European Application Serial No. 08253065.0, Response filed Feb. 8, 2012 to Examination Notification mailed Oct. 11, 2011", 15 pgs.
"European Application Serial No. 08253065.0, Response to Office Action filed Feb. 28, 2011 to European Office Action mailed Aug. 26, 2010", 17 pgs.
"European Application Serial No. 08725262.3, Office Action mailed Apr. 21, 2010", 6 Pgs.
"European Application Serial No. 08725262.3, Office Action mailed Aug. 5, 2011", 5 pgs.
"European Application Serial No. 08725262.3, Office Action Response Filed Nov. 2, 2010", 14 pgs.
"European Application Serial No. 08725262.3, Response filed Feb.

(56) References Cited

OTHER PUBLICATIONS 13, 2012 to Office Action mailed Aug. 5, 2011", 11 pgs.
"European Application Serial No. 09168844.0, European Search Report mailed Apr. 19, 2010", 3 Pgs.
"European Application Serial No. 09168844.0, Office Action mailed Apr. 28, 2011", 5 pgs.
"European Application Serial No. 09168844.0, Office Action mailed May 3, 2010", 5 pgs.
"European Application Serial No. 09168844.0, Office Action Response Filed: Nov. 15, 2010", 8 pgs.
"European Application Serial No. 09250729.2, Extended Search Report Mailed Dec. 14, 2009", 4 pgs.
"European Application Serial No. 10251319.9, Office Action mailed Jan. 3, 2012", 6 pgs.
"International Application Serial No. PCT/US2008/001609, International Preliminary Report on Patentability mailed Aug. 20, 2009", 10 pgs.
"International Application Serial No. PCT/US2008/001609, Search Report mailed Jun. 19, 2008", 7 pgs.
"International Application Serial No. PCT/US2008/001609, Written Opinion mailed Jun. 19, 2008", 8 pgs.
Buchoff, L S, "Advanced Non-Soldering Interconnection", Electro International, 1991 (IEEE), XP 10305250A1, (1991), 248-251.
Tondra, Mark, "Flow Assay With Integrated Detector", U.S. Appl. No. 60/887,609, filed Feb. 1, 2007, 28 pgs.
"U.S. Appl. No. 12/644,188, Advisory Action mailed Jul. 25, 2013", 3 pgs.
"U.S. Appl. No. 12/644,188, Final Office Action mailed May 22, 2013", 7 pgs.
"U.S. Appl. No. 12/644,188, Non Final Office Action mailed Sep. 9, 2013", 9 pgs.
"U.S. Appl. No. 12/644,188, Non Final Office Action mailed Sep. 19, 2012", 8 pgs.
"U.S. Appl. No. 12/644,188, Notice of Allowance mailed Mar. 21, 2014", 5 pgs.
"U.S. Appl. No. 12/644,188, Response filed Feb. 19, 2013 to Non Final Office Action mailed Sep. 19, 2012", 6 pgs.
"U.S. Appl. No. 12/644,188, Response filed Jul. 22, 2013 to Final Office Action mailed May 22, 2013", 6 pgs.
"U.S. Appl. No. 12/644,188, Response filed Dec. 9, 2013 to Non Final Office Action mailed Sep. 9, 2013", 6 pgs.
"European Application Serial No. 10251319.9, Response filed Jul. 24, 2012 to Extended European Search Report mailed Jan. 3, 2012", 10 pgs.

* cited by examiner

METHOD AND APPARATUS FOR AN INSULATED ELECTROMAGNETIC SHIELD FOR USE IN HEARING ASSISTANCE DEVICES

RELATED APPLICATION

The present application claims the benefit under 35 U.S.C. 119(e) of U.S. Provisional Patent Application Ser. No. 61/228,091, filed Jul. 23, 2009, which is incorporated herein by reference in its entirety.

FIELD OF THE INVENTION

The present subject matter relates generally to the management of electromagnetic fields in hearing assistance devices, such as hearing aids, and in particular to an insulated electromagnetic shield design for hearing assistance devices.

BACKGROUND

As hearing assistance devices get smaller, component densities may increase. With such designs there is typically less room to arrange the components and a greater likelihood of electromagnetic interference between components. Certain hearing assistance devices, such as hearing aids, are increasingly including wireless communication capabilities. Such devices can suffer from electromagnetic field interference between components. Thus, there is a need in the art for improved management of electromagnetic fields for components in hearing assistance devices.

SUMMARY

Disclosed herein, among other things, are methods and apparatus for management of electromagnetic fields in hearing assistance devices. According to various embodiments, the present subject matter includes a method and apparatus for shielding components to avoid electromagnetic interference.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1A:
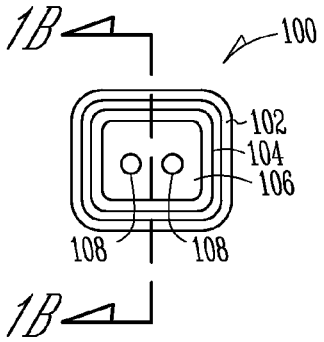
FIG. 1A shows an end view of an insulated electromagnetic shield for a receiver, according to one embodiment of the present subject matter.

The present subject matter of the invention relates generally to the management of electromagnetic fields in hearing assistance devices, such as hearing aids, and in particular to an insulated electromagnetic shield design for hearing assistance devices. The present disclosure includes various embodiments for electromagnetic shielding of a receiver using a magnetic shield that is electrically insulated from the receiver casing and electronics. FIG. 1A shows an end view of an insulated electromagnetic shield for a receiver, according to one embodiment of the present subject matter. The shielded receiver 100 assembly in FIG. 1A includes an electromagnetic shield 102, insulator 104, and receiver 106 with terminals 108. In one embodiment, the electromagnetic shield 102 is a high magnetic permeability material, such as a mu metal "envelope" or "can" adapted to fit around insulator 104 and receiver 106. The insulator 104 provides electrical insulation between receiver 106 case and shield 102. The insulator 104 may also be selected to provide certain mechanical vibrational dampening or isolation, in various embodiments.

The present insulated shield differs from other apparatus that provide electrical connection between the receiver and/or its casing and the shield. For example, in assemblies where the shield wraps around the receiver without an insulator, there is a conductive connection between the shield and at least the cover of the receiver. Such designs do not provide mechanical isolation between the shield and the receiver case.

The present subject matter includes insulation to improve the electromagnetic shielding of a component. The present subject matter provides magnetic shielding in close proximity to the receiver itself to reduce the size of the assembly (and therefore a devices, such as a hearing aid, employing it), provide a pre-shielded component (such as a receiver) that reduces final assembly steps, and/or constrain the physical size of the shield in order to keep it away from internal device (e.g., hearing aid) components that may be adversely affected by large masses of metal. Examples of such components include, but are not limited to an RF or inductive antenna (e.g., a telecoil), a reed switch, giant magnetorestrictive (GMR) or tunneling magnetorestrictive (TMR) sensor used to detect a static magnetic field of a proximal telephone. The results of testing have shown that components that are electrically connected to the shield obtain less effective shielding than components shielded with the insulated shield of the present subject matter. Different measurements will be discussed which show substantial improvement in shielding using the insulated shield approach of the present subject matter. For example, in one experiment the insulated shield assembly provided about 10 dB more effective than one with a conductive connection to the receiver case.

Figure 1B:
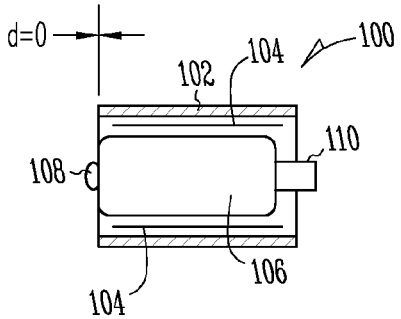
FIGS. 1B-1E show side view cross sections of some various insulated shielded receivers according to various embodiments of the present subject matter.
Figure 1C:
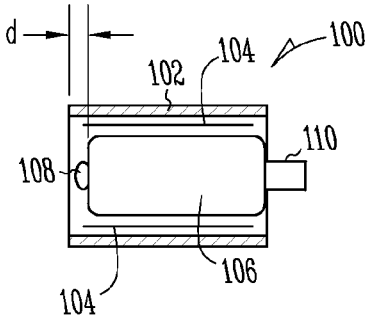
Figure 1D:
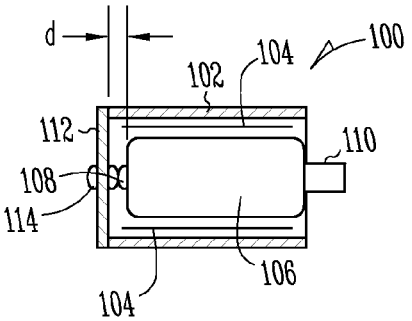
Figure 1E:
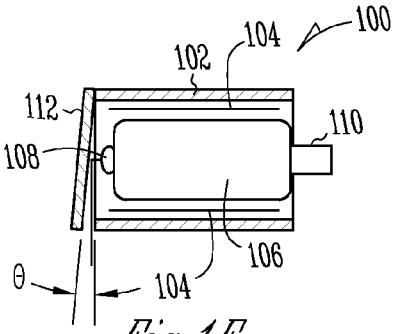

FIG. 1B shows a side view cross section of an insulated shielded receiver according to one embodiment of the present subject matter. In the embodiment of FIG. 1B the shield 102 is insulated from the receiver 106 using insulation 104. In various embodiments, the insulator thickness is less than one mil. In various embodiments, thicker insulators may be used. Test units have used 3M 471 (5 mil) tape. Good results have also been reported using irradiated PVC or Teflon shrink tubing and other materials. The spacing is not critical to the shielding effect, only the prevention of ohmic contact. In this example, the shield ends at about the point where solder terminals 108 of the receiver are situated. FIG. 1C shows another embodiment where the shield 102 extends a distance d past the end of the receiver housing to provide shielding around the area of the solder terminals 108. It is understood that other assemblies may have shorter or longer shields according to various embodiments of the present subject matter. FIG. 1D shows an example where the shield 108 extends a distance d beyond the solder terminals 108 and an end-cap 112 with conductive pads provides connection to the solder terminals 108. In one embodiment, the end-cap 112 is constructed of high permeability material, such as mu metal. It can employ a variety of connection approaches including a printed circuit board for providing the contact pads to solder terminals 108. A number of connection approaches can be used, including, but not limited to the use of soldering and conductive paste. FIG. 1E shows one variation whereby end-cap 112 is connected to one side of the shield to allow wires soldered to solder terminals 108 to extend from the package. FIGS. 1B-1E show a sound outlet or "spout" 110 of the receiver which provides sound output from the receiver.

Figure 2A:
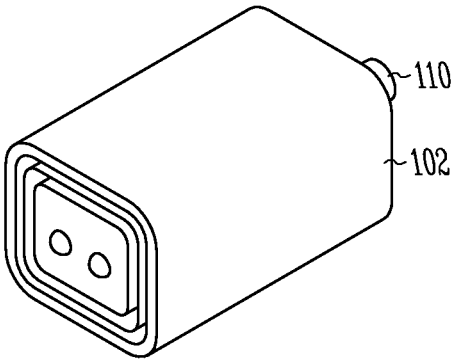
FIGS. 2A-2C show perspective views of the insulated shielded receivers of FIGS. 1B-1D, respectively, according to various embodiments of the present subject matter.
Figure 2B:
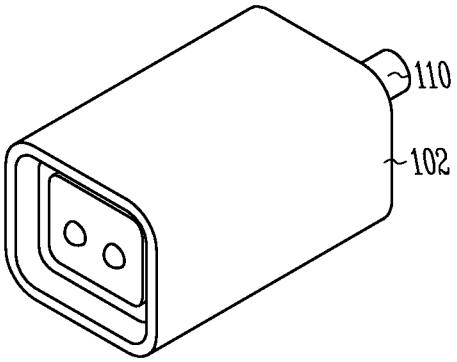
Figure 2C:
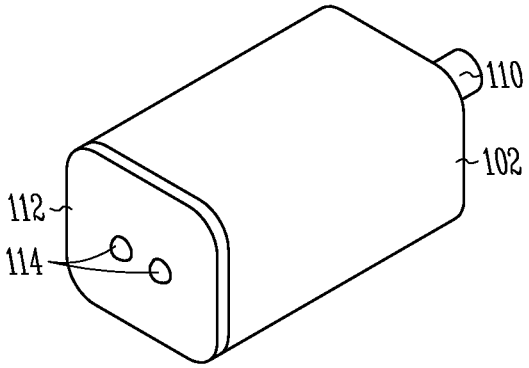

FIG. 2A shows an example shield where the shield does not extend the extra distance d, according to one embodiment of the present subject matter, such as that set forth in FIG. 1B. FIG. 2B shows an example shield which does extend the distance d past the end of the receiver (see FIGS. 1C-1E), according various embodiments of the present subject matter. FIG. 2C shows the shield of FIG. 2B with an end-cap 112 attached to the shield and having solder pads mounted on a small insulating printed circuit board 114 providing electrical contacts to the solder terminals 108, according to one embodiment of the present subject matter. In various embodiments, the end-cap 112 is made of a high permeability material, such as a mu metal, to enhance shielding at the terminal end of the receiver. The various embodiments in FIGS. 2A, 2B, and 2C can be used for different applications and with different characteristics. Studies show that the shielding property of the design of FIG. 2B exceed that of FIG. 2A by about 5 dB in one experiment.

Figure 3:
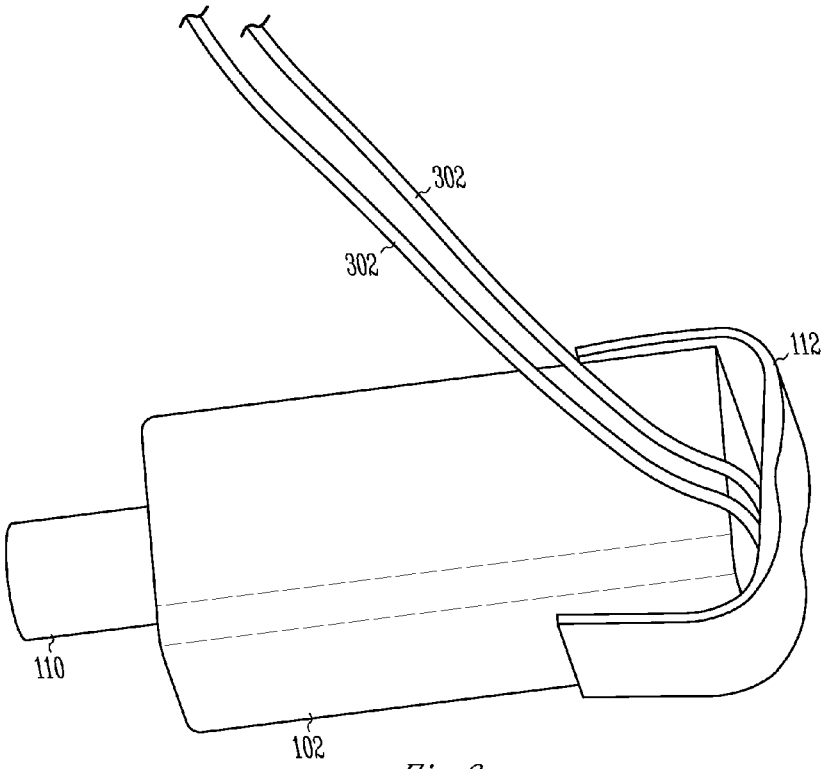
FIG. 3 shows one example of an insulated shielded receiver, such as the one shown in FIG. 1E, with an end-cap having a slit outlet for wires connected to the receiver, according to one embodiment of the present subject matter.

FIG. 3 shows one example of an insulated shielded receiver, such as the one shown in FIG. 1E, with an end-cap 112 having a slit outlet for wires 302 connected to the receiver to more fully shield the terminals 108.

The present insulated shield can be applied to any number of small receiver designs. The present shield has been tested on a Sonion 4400 receiver and the Knowles DFK 60645-155. However, it is understood that any receiver design can benefit from the present insulated receiver approach.

It is understood that in various embodiments, a formed can may be fabricated for the receiver/insulator combination to slide into. In various embodiments, an insulating layer can be applied to the inner surface of the can. In various embodiments an insulative coating is applied to the outside of the receiver can. Other insulator approaches may be used without departing from the scope of the present subject matter.

The present insulated shield provides a means for shielding a hearing aid receiver to reduce electromagnetic emissions. This shielding is particularly amenable to manufacturing and installation by the receiver component manufacturer and reduces the manufacturing steps required at final assembly. The thin insulating layer reduces the volume of the shielded receiver assembly. The shield forms a sleeve that extends to envelope the entire length of the receiver case. It is understood that this envelope or "can" may include the entire length of the spout of sound outlet. For best results it has been determined by experimental testing that the envelope should include the length of the electrical termination of the receiver, but may be shorter in other embodiments.

Measurements were performed on various approaches using the insulated shield of the present subject matter. In one experiment, a magnetic probe situated about ½ inch from a receiver with no shielding was performed. The receiver was given a 1 KHz, 0.5 VRMS input signal and the magnetic field was measured to be 6.2 mA/M. This measurement was repeated using a shield that was conductively connected to the receiver case. This test yielded a 3 dB improvmement (4.4 mA/M). The test was repeated using an insulated shield of the present subject matter similar to the shield of FIG. 1B. This insulated shield assembly produced a 10 dB improvement in shielding from the conductively connected shield and a 13 dB improvement in shielding from the unshielded receiver (1.4 mA/M). The test was repeated yet one more time using a longer insulated shield, such as the one set forth in FIG. 1C. This provided an 18 dB improvement in shielding over the unshielded receiver, a 15 dB improvement over the shield connected to the receiver case, and a 5 dB improvement over the insulated short shield (0.8 mA/M). Thus, the effectiveness of the insulated shield is demonstrated, and appears to be enhanced for a longer shield which covers the solder terminals 108.

The present subject matter affords one or more advantages over other approaches, including, but not limited to, increased shielding effectiveness, reduced shielded assembly size, it may include the shielding as a stage of the receiver component assembly, and may reduce final assembly complexity. The subject of this disclosure promotes ease of final assembly, since the shielding is supplied pre-assembled onto the receiver as delivered by the receiver manufacturer. The shielding reduces interference to nearby magnetically-sensitive components and allows closer proximity of said components to the receiver thereby achieving the positive result of allowing a smaller hearing design envelope. In various embodiments, the present subject matter can allow higher gains and outputs within a smaller package.

Figure 4:
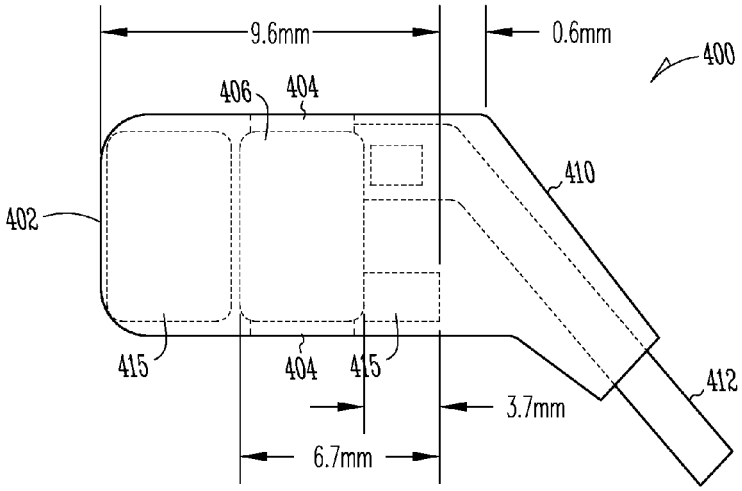
FIG. 4 shows another example of an insulated shielded receiver, according to one embodiment of the present subject matter

Another example of an insulated shielded receiver is shown in FIG. 4, according to one embodiment of the present subject matter. Insulated shielded receiver assembly 400 includes a receiver 406 that is mounted in a high permeability material (such as a mu metal) envelope or "can" 402. The envelope 402 provides improved electromagnetic shielding and facilitates close physical collocation of a receiver and a telecoil in a hearing assistance device, such as a hearing aid. The design in FIG. 4 shows positioning blocks 415 adapted to hold the receiver 406 in position and provide suitable mechanical vibration isolation. These positioning blocks are optional and an envelope can be adapted to enclose the receiver 406 and provide insulation from the envelope 402 without using positioning blocks. This design also allows for new placement configurations for a telecoil, thereby providing new aesthetic design options for hearing assistance devices. The assembly includes a spout 410 that may include tubing 412 from the receiver for transmission of sound. Other dimensions and orientations and designs are possible without departing from the scope of the present subject matter. Thus, the dimensions shown in FIG. 4 are demonstrative and not intended in an exhaustive or exclusive sense.

In one embodiment, a dual-motor hearing aid receiver designed so the two motors operate to cancel each others' radiated magnetic fields may be used in conjunction with external magnetic shielding to allow a telecoil to be placed in close proximity to said receiver. This configuration and combination of elements can permit a design with a telecoil located much closer to the receiver than previous designs that do not use a dual-motor receiver not modified for radiated field cancellation. Although not necessarily advantageous for all telecoil locations in relation to the receiver, the proposed configuration allows telecoil placements heretofore not possible using standard dual or single-motor receivers that do not produce intentional field cancellation effects.

In one approach, dual-voice-coil receivers with mu metal housings were assembled with one of the voice coils wound to produce an opposing magnetic field to the field created by the other voice coil. These opposing fields create magnetic nulls and an overall decrease in the strength of the radiated fields in specific locations relative to the housing of the receiver. In hearing aid applications, this reduces interaction between the radiated field from the hearing aid receiver and a co-located telecoil that can produce unwanted feedback and alterations in frequency response in the telecoil system, interfering with its function of transducing telephone and assistive loop system signals. Placement of the telecoil within the regions of low magnetic radiation created by the modified receiver assembly allows the telecoil to be placed closer to the receiver in a number of specific locations. Some of these locations have not been accessible to telecoil placement in the past due to the standard receiver's magnetic radiation, even with magnetic shielding in place. In various embodiments, cancellation occurs near the spout of the receiver (which may be an advantage in mini and micro-BTE applications), along the seam line of the dual receiver (which is usually aligned along the center line of the long axis of a behind-the-ear (BTE) hearing instrument), and/or at angles off certain edges of the receiver (potentially useful in receiver-in-canal (RIC), in the canal (ITE), Canal and completely in the canal (CIC) applications).

The addition of shielding between the modified receiver and telecoil combines with the alteration in the magnetic field pattern to allow very close proximity of telecoil to receiver. This shielding may be drawn or metal-injection-molded mu-metal, a plastic part plated with mu-metal-like material characteristics or composed of a combination of such materials. Such close proximity of telecoil to receiver facilitates packaging for modular design.

The present subject matter includes hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus, comprising:

a receiver, adapted for use in a hearing aid, the receiver including a conductive housing;

an insulator disposed around at least a portion of the conductive housing of the receiver; and an envelope configured to conform around at least a portion of the insulator, wherein the envelope extends a length of electrical termination of the receiver, wherein the envelope includes a magnetically shielding material and the insulator is adapted to electrically insulate the envelope from the conductive housing.

2. The apparatus of claim 1, wherein the magnetically shielding material is a high permeability material.

3. The apparatus of claim 1, wherein the magnetically shielding material includes mu metal.

4. The apparatus of claim 1, wherein the envelope includes a plastic part.

5. The apparatus of claim 1, wherein the magnetically shielding material includes a drawn part.

6. The apparatus of claim 1, wherein the magnetically shielding material includes a metal-injection-molded part.

7. The apparatus of claim 1, wherein the envelope provides electromagnetic shielding.

8. The apparatus of claim 1, wherein the receiver is a dual-motor hearing aid receiver.

9. The apparatus of claim 1, further comprising a magnetically sensitive element proximal the envelope of the receiver.

10. The apparatus of claim 9, wherein the magnetically sensitive element includes a TMR sensor.

11. The apparatus of claim 9, wherein the magnetically sensitive element includes a GMR sensor.

12. The apparatus of claim 1, further comprising an antenna proximal the envelope.

13. The apparatus of claim 1, wherein the magnetically shielding material extends a distance past an end of the receiver.

14. The apparatus of claim 1, wherein the insulator is about 1 mil thick.

15. A hearing aid, comprising:

a dual-motor receiver, adapted for use in a hearing aid, the receiver including a conductive housing;

an insulator disposed around at least a portion of the conductive housing of the receiver;

an envelope configured to conform around at least a portion of the insulator, wherein the envelope extends a length of electrical termination of the receiver; and a magnetically sensitive element proximal the envelope of the receiver, wherein the envelope provides a magnetic and electromagnetic shield and the insulator is adapted to electrically insulate the envelope from the conductive housing.

16. The apparatus of claim 15, wherein the magnetically sensitive element includes a TMR sensor.

17. The apparatus of claim 15, wherein the magnetically sensitive element includes a GMR sensor.

18. The apparatus of claim 15, further comprising an antenna proximal the envelope.

19. The apparatus of claim 15, wherein the magnetically shielding material extends a distance past an end of the receiver.

20. The apparatus of claim 15, wherein the insulator is about 1 mil thick.

21. A method comprising:

assembling an assembly comprising a receiver with a conductive casing, an insulative element disposed about the conductive casing, and an electromagnetic shield disposed about the insulative element, such that the conductive casing is electrically insulated from the electromagnetic shield, the assembly adapted for use in a hearing aid, wherein the assembly includes an envelope extending a length of electrical termination of the receiver.

22. The method of claim 21, further comprising disposing the assembly in a hearing aid design, the assembly positioned proximal a magnetically sensitive element, an antenna, another component, or a combination of these.

* * * * *